United States Patent [19]

Froyland et al.

[11] Patent Number: 4,968,094

[45] Date of Patent: Nov. 6, 1990

[54] DEVICE FOR VERTICAL ADJUSTMENT OF ARM SUPPORTS ON CHAIRS, ESPECIALLY WHEEL CHAIRS

[76] Inventors: Arnfinn Froyland, Nevern. 1, N-4320, HommersÅk; Thorbjorn Lohre, Grotnesvn. 25, N-4052, Royneberg, both of Norway

[21] Appl. No.: 363,268

[22] Filed: Jun. 8, 1989

[30] Foreign Application Priority Data

Jun. 13, 1988 [NO] Norway ..... 882600
Jan. 13, 1989 [NO] Norway ..... 890150

[51] Int. Cl.[5] ..... A47C 7/54

[52] U.S. Cl. ..... 297/411; 297/417; 297/361; 297/374

[58] Field of Search ..... 297/411, 417, 375, 374, 297/361; 248/188.5, 161

[56] References Cited

U.S. PATENT DOCUMENTS 3,062,584 11/1962 Galla ..... 297/374
3,127,788 4/1964 Martens ..... 297/374
3,350,135 10/1967 Martens ..... 297/361
3,398,986 8/1968 Homier ..... 297/361
3,993,351 11/1976 Rodaway ..... 297/417
4,489,981 12/1984 Goletski ..... 297/417

*Primary Examiner*—Peter A. Aschenbrenner
*Attorney, Agent, or Firm*—Foley & Lardner, Schwartz, Jeffery, Schwaab, Mack, Blumenthal & Evans

[57] ABSTRACT

In a device for vertical adjustment of arm supports on chairs, especially wheel chairs, each arm support (1) is carried by a support pipe (2) longitudinally displaceably arranged in a bore (3') of a part (3) rigidly connected to the chair frame (1'), the support pipe (2) being lockable to the chair frame (1', 3) in its various positions of longitudinal displacement. It is aimed at providing a device of this kind wherein the height adjustment of the arm support occurs infinitely variably and controlled, and wherein the height-adjusting device is handy in use. For this purpose a longitudinally non-displacebable motion screw is rotationally supported within the support pipe (2), a lug (5) rigidly connected to the chair frame (1', 3) engaging said motion screw, the latter being adapted to cooperate with a manually releasable (8) locking device (9,10) which in the locking position prevents rotation of the motion screw (4).

4 Claims, 2 Drawing Sheets

DEVICE FOR VERTICAL ADJUSTMENT OF ARM SUPPORTS ON CHAIRS, ESPECIALLY WHEEL CHAIRS

This invention relates to a device for vertical adjustment of arm supports on chairs, especially wheel chairs, wherein each arm support is carried by a support pipe longitudinally displaceably arranged in a bore of a part fixedly connected to the chair frame, and wherein the support pipe can be locked to the chair frame in its various positions of longitudinal displacement.

In a known device for vertical adjustment of this kind, each of the support pipes of the arm supports is telescopically displaceable in a pipe fixedly connected to the chair frame. A screw bolt serves to lock the telescopically displaceable support pipe to the frame pipe upon adjustment of height, the locking bolt is unscrewed, whereafter the support pipe is displaced telescopically in the frame pipe until one has achieved the desired adjustment of height of the arm support. Thereafter, the locking bolt is tightened again.

This known device for vertical adjustment of arm supports is cumbersome in use and, moreover, it is often difficult to obtain an exact adjustment of height.

The object of this invention is to provide an infinitely variable vertical adjustment device of the kind concerned which is handy in use and wherein it additionally is easy to effect an accurate adjustment of height.

This object is achieved through the features defined in the characterizing part of the following claim 1.

Through rotary mounting of an axially non-displaceable motion screw in the support pipe for the arm support and wherein engages a lug fixedly connected to the chair frame, an infinitely variable adjustment of the vertical position of the arm support is achieved whenever the arm support is raised or lowered. The motion screw also ensures a very accurate adjustment of the vertical position of the arm support. The motion screw is provided with a manually releasable locking device which in its locking position prevents rotation of the screw. Such a locking device can be constructed very simply and, according to a preferred embodiment, consists of a handle-controlled cotter pin which may be brought into and out of engagement with a preferably cross-shaped groove in the adjacent gable surface of the motion screw.

Other embodiments representing advantageous further developments of the invention, appear from the sub claims.

Figure 1:
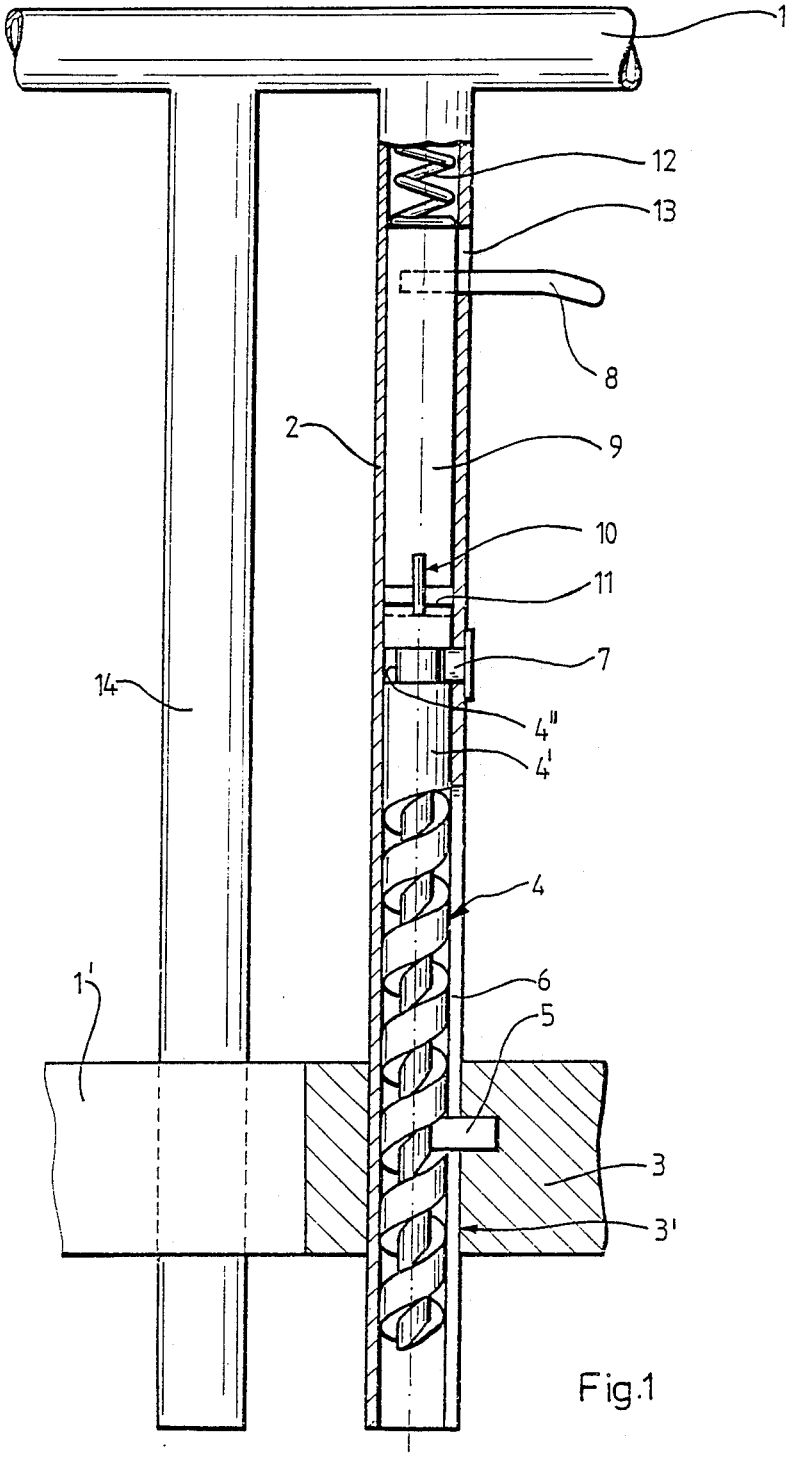
Figure 2:
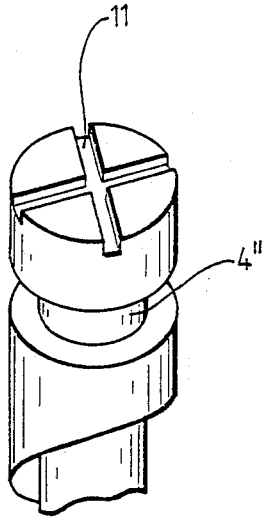

An example of execution of an infinitely variable device for vertical adjustment of arm supports is closer explained in the following, reference is being made to the accompanying drawings, wherein:

FIG. 1 in side elevation/axial section shows a device for vertical adjustment of arm supports in accordance with the invention; and FIG. 2 in perspective shows a detail view of the upper end portion of the motion screw.

In the drawings, reference numeral 1 denotes one of the arm supports incorporated into a wheel chair frame 1' only shown partially.

The arm support 1 is carried by a vertical support pipe 2 which is axially displaceably supported in a bore 3' of a bracket 3 rigidly connected to the chair frame 1'.

Rotationally arranged in the lower portion of the support pipe 2 is a motion screw 4, the upper portion 4' of which is formed without screw threads. In between the threads of the motion screw engages a lug 5 fastened to the bracket 3 and extending through a longitudinal slot 6 of the support pipe 2. This slot 6 should have a longitudinal extension somewhat exceeding the desired maximum area of height adjustment for the arm support 1.

The upper unthreaded portion 4' of the motion screw is provided with a circumferential groove 4'' wherein a lug 7 attached to the support pipe 2 engages. The engagement of the lug 7 within the circumferential groove 4'' of the screw prevents axial displacement of the screw 4.

A simple handle 8 is rigidly connected to an axially displaceable locking slide 9 in the support pipe 2, said locking slide lowermost carrying a locking cotter 10 for engagement in a preferably cross-shaped groove 11, FIG. 2, formed in the adjacent gable surface of the motion screw. The locking slide 9 is spring-loaded downwards toward locking position, FIG. 1, but the engagement of the locking cotter 10 within the cross-groove 11 can be released through moving the handle 8 a short distance upwards in a slot 13 of the support pipe. Thereby, the locking cotter 10 if lifted clear of the groove 11, whereafter the motion screw 4 can rotate freely.

Through lifting or lowering the arm support 1 in this position in order to achieve the desired position of height, the screw 4 is rotated in the one or other direction, the stationary lug 5 engaging in between its threads. The support pipe 2 of the arm support 1 is thereby displaced upward or downward until the desired height position of the arm support 1 is reached. Thereafter, the handle 8 is released and the spring 12 brings the locking cotter 10 of the locking slide 9 into engagement within the locking groove 11 of the screw 4, whereafter the height position of the arm support is locked.

Through the use of a sufficiently heavy locking slide 9, the spring may possibly be omitted.

14 denotes a support pipe extending freely through the bracket 3 and parallel to the support pipe 2.

The arm support height adjusting device according to the invention is very handy in use. Infinitely variable adjustment of height is achieved.

Simultaneously, the motion screw offers a small but desired resistance during the vertical adjustment, which thereby becomes much more controlled than what previously has been possible by means of telescopic pipes.

We claim:

1. A chair having adjustable arm supports, comprising:

a chair frame;

means, fixedly connected to said chair frame, defining a longitudinal bore;

a support pipe logitudinally displaceable in said bore;

an arm support carried by said support pipe;

said support pipe being adapted to be locked to said chair frame in various longitudinal positions;

an axially fixed motion screw rotatably supported in said support pipe;

a lug rigidly connected to said chair frame, said lug engaging said motion screw between threads thereof;

a manually releasable locking means cooperating with said motion screw, said locking means preventing rotation of said motion screw in a locking position thereof;

said locking means comprising a longitudinally displaceable slide disposed within said support pipe, said slide having a locking cotter at a lower end thereof and an external handle at an upper end thereof adjacent said arm support, said external handle being guided in a first slot extending longitudinally in said support pipe, said locking cotter being adapted to cooperate and lock into a locking groove formed in an end portion of said motion screw, said first slot having a length exceeding the depth of engagement between said locking cotter and said locking groove; and a second slot extending longitudinally in said support pipe in the area of said lug, the longitudinal length of said second slot being greater than the desired maximum height adjustment for said arm support.

2. The chair according to claim 1, further comprising means for urging said slide downward to a locking position.

3. The chair according to claim 1, wherein said locking groove has a cross-shaped cross section.

4. The chair according to claim 1, wherein said motion screw has a non-threaded end portion which faces said slide, a circumferential second groove, a second lug rigidly connected to said support pipe and engaging said second groove, thereby preventing longitudinal displacement but allowing rotation of said motion screw relative to said support pipe.

* * * * *